US009734521B2

(12) United States Patent
Curtis et al.

(10) Patent No.: US 9,734,521 B2
(45) Date of Patent: Aug. 15, 2017

(54) SUBSCRIPTION MODEL FOR TRUSTED RECOMMENDATION SOURCES

(71) Applicant: Google Inc., Mountain View, CA (US)

(72) Inventors: Duncan John Curtis, Castro Valley, CA (US); Alexander Ruben Stacey McCarthy, San Francisco, CA (US)

(73) Assignee: Google Inc., Mountain View, CA (US)

( * ) Notice: Subject to any disclaimer, the term of this patent is extended or adjusted under 35 U.S.C. 154(b) by 230 days.

(21) Appl. No.: 14/207,381

(22) Filed: Mar. 12, 2014

(65) Prior Publication Data

US 2015/0262266 A1 Sep. 17, 2015

(51) Int. Cl.
*G07F 19/00* (2006.01)
*G06Q 30/04* (2012.01)

(52) U.S. Cl.
CPC ..... *G06Q 30/04* (2013.01)

(58) Field of Classification Search
CPC ..... G06Q 30/04; G06Q 40/00; G06Q 40/06; G06Q 40/10; G06Q 20/102
USPC ..... 705/34, 35, 36
See application file for complete search history.

(56) References Cited

U.S. PATENT DOCUMENTS 7,668,752 B2 * 2/2010 Wright ..... G06Q 10/08 705/17
7,716,125 B2 * 5/2010 Shavit ..... G06Q 40/00 705/38
8,286,229 B2 10/2012 Bodin et al.
8,370,874 B1 * 2/2013 Chang ..... H04N 21/4532 725/44
9,251,539 B2 * 2/2016 Imrey ..... G06Q 20/027
2010/0312678 A1 * 12/2010 Davis ..... G06Q 20/02 705/30
2011/0145086 A1 * 6/2011 Valdes ..... G06Q 20/10 705/26.1
2011/0321072 A1 * 12/2011 Patterson ..... H04N 21/44222 725/5
2013/0262431 A1 10/2013 Garner et al.

OTHER PUBLICATIONS

Patreon, www.patreon.com and a series of print outs of the website, courtesy of Wayback Machine.*
Patreon1, youtube video explaining Patreon website Oct. 6, 2013, transcribed.*
Wired Magazine, The Next Big Thing You Missed: Eternal Kickstarter Reinvents Indie Art, Ryan Tate Oct. 22, 2013.*

* cited by examiner

*Primary Examiner* — Andrew Joseph Rudy
(74) *Attorney, Agent, or Firm* — Morris & Kamlay LLP

(57) ABSTRACT

Systems, device and techniques are disclosed for receiving content based on a subscription to channel by a user. An indication of a user subscription, by a user, may be received. The subscription may be for a channel associated with a channel manager for the channel. An indication of a content to be provided via the channel may be received from the channel manager for the channel. A determination may be made that the content value associated with the content is below an available user subscription value. The content may be automatically provided to the user, based on the determination and the content value may be deducted from the available subscription value.

30 Claims, 4 Drawing Sheets

SUBSCRIPTION MODEL FOR TRUSTED RECOMMENDATION SOURCES

BACKGROUND

Spending habits and tastes of users that purchase software content, such as applications for a mobile phone, can be erratic and some users may find it difficult to decide what software content to purchase. Users often relying on friends or advertisement to suggest software content such as gaming applications. As an example, ten new music applications may be available via an application store. A user that searches for music applications and may be provided with the option to download any of the music applications. However, the user may not know which music application is optimal for the user and, thus, may be required to ask her friends or conduct research to select an application.

BRIEF SUMMARY

According to implementations of the disclosed subject matter, an indication of a user subscription, by a user, may be received. The subscription may be for a channel associated with a channel manager for the channel. An indication of a content to be provided via the channel may be received from the channel manager for the channel. A determination may be made that the content value associated with the content is below an available user subscription value. The content may be automatically provided to the user, based on the determination and the content value may be deducted from the available subscription value.

According to implementations of the disclosed subject matter, a systems and devices for providing content may include means for receiving an indication of a user subscription to a channel associated with a channel manager for the channel. The system includes means for receiving an indication of a first content to be provided via the channel, from the channel manager for the channel. Means for determining that a content value associated with the first content is below an available user subscription value may be provided. Additionally, means for automatically providing the content to the user, may be provided. Means for deducting the content value from the available subscription value may also be provided.

Systems and techniques according to the present disclosure enable providing content to a user that has subscribed to a channel. Additional features, advantages, and implementations of the disclosed subject matter may be set forth or apparent from consideration of the following detailed description, drawings, and claims. Moreover, it is to be understood that both the foregoing summary and the following detailed description include examples and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate implementations of the disclosed subject matter and together with the detailed description serve to explain the principles of implementations of the disclosed subject matter. No attempt is made to show structural details in more detail than may be necessary for a fundamental understanding of the disclosed subject matter and various ways in which it may be practiced.

DETAILED DESCRIPTION

Figure 1:
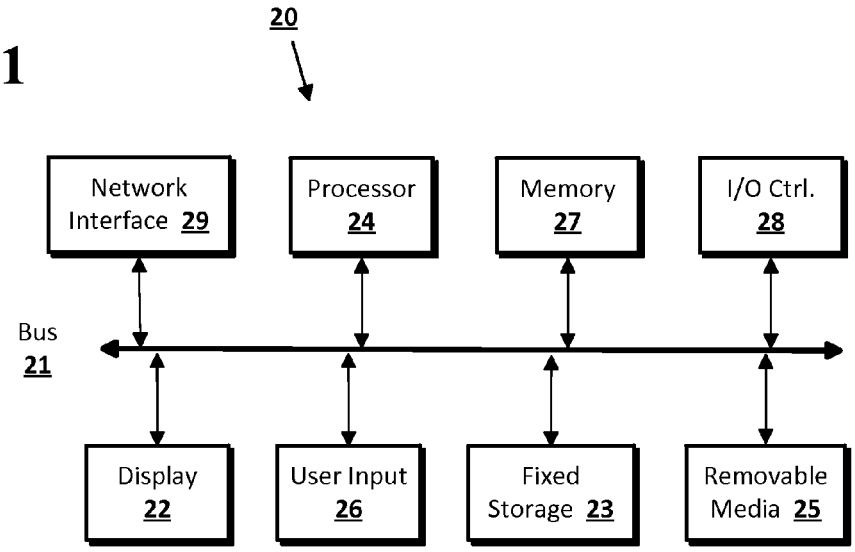
FIG. 1 shows a computer according to an implementation of the disclosed subject matter.

Techniques disclosed herein may enable users to subscribe to a channel that is operated by a channel manager. The user may receive content based on the subscription to the channel. The content may be suggested by the content manager such that the content manager may select content that is downloaded on the user's device. Here, a user may subscribe to one or more channels that the user designates as channels that are will provide content that the user is likely to use. By using the subscription to the one or more channels, users may not need to search for content within a content market place and may receive content from a trusted source (i.e., the content manager). The users may subscribe to the channel for a given amount of money per time period. For example, a use may subscribe to a channel that provides video game applications to the user. The cost for the subscription may be 10 dollars per month. The amount of content that a user can receive per subscription time period may correspond to the amount that the content costs and the subscription value. Continuing the previous example, the user may receive up to 10 dollars worth of content per month. During a subsequent month, another 10 dollars may be deducted from the user's account and the user may receive another set of content that costs up to 10 dollars. A replenish period may be the time after a subscription time period when funds are deducted from a user account (e.g., a bank or charge account) and/or the available subscription value for a channel that a user is subscribed to increases. In the previous example, the subsequent month where another 10 dollars is deducted from the user's account can be the replenish period. The replenish period may coincide with a subscription period and may be any applicable time period such as a day, week, month, year, or the like.

As disclosed herein, content may correspond to any software that can be used by a user. The software content may be applications, programs, and media content such as music, videos, text, or the like. Some examples of specific content can include gaming applications, productivity applications, books, business applications, catalogs, education applications, entertainment applications, finance applications, food and drink applications, health and fitness applications, kids applications, lifestyle applications, medical applications, music applications, navigation applications, news applications, media applications, social networking applications, sports applications, travel applications, utility applications, weather applications, and the like. Additionally, content may include in application purchases that can be made within an application that is included with a channel. As an example, a user may receive a hunting game application via a channel that the user is subscribed to. The hunting game application may enable a user to purchase additional items within the game that can enhance the user's experience such as outfits for a character in the game, precision devices, and the like. The channel manager for the channel which provides the application may also include pre-selected in app purchase items along with the hunting game. Accordingly, the user would receive the hunting game as well as the in app purchases selected by the channel manager.

As disclosed herein, a channel manager may be any applicable entity capable of selecting content to be provided to a user via a channel. The channel manager may be an individual user (e.g., a programmer, a developer, a friend, a trusted user, etc.), a brand, a company, or the like. As an example, a user may elect to be a channel manager by creating a channel and providing content suggestions via the channel. A different user may subscribe to the original user's channel and receive content via the channel. As another example, a gaming company may elect to suggest content to users via a channel. A user B may subscribe to the gaming company's channel and receive suggested content via the channel. Alternatively, a channel manager may be a known user to whom a subscribing user can directly subscribe to. The known user that is subscribed to may operate as a channel manager based on the subscribing user's subscription. As an example, a child family member may subscribe to a parent family member and the parent family member may select content to be provided to the child family member. It will be understood that a channel manager need not purchase the content that the channel member provides to subscribers of a channel associated with the channel member. Further, a channel member may provide content via a channel that is only available to subscribers via the channel. As an example, a gaming company may provide gaming applications or in application items that are not available to the general public without a subscription to the channel.

A channel manager may select content to be provided to subscribers via any applicable technique such as by selecting the content on an electronic device, by selecting a group of content items, or the like. A channel manager may select all the content for a subscription period (e.g., a month) at once or may periodically provide content throughout the subscription period. As an example, a channel manager may select a gaming application at the beginning of a subscription month. Subsequently, as the month progresses, the channel manager may select additional applications for subscribers.

An available subscription value may be the amount of funds available to a user for receiving applications. The available subscription value may be the value of funds remaining for a given channel such that the funds can be applied towards additional content. The available subscription funds may be initially be equal to, for example, an amount that a subscription to a channel costs. As an example, a user may opt to contribute 10 dollars a month towards a monthly subscription channel and, accordingly, when the user initially subscribes to the channel, the amount allocated for the user is 10 dollars. An available subscription value may be modified based on payments from the user towards a channel. Continuing the pervious example, after a first month, 10 additional dollars may be allocated to the user and may be applied towards additional content provided via the channel. The available subscription value may be replenished automatically upon the culmination of a subscription period (e.g., a week, a month, etc.) or authorization to continue the subscription may be requested from the user that is subscribed to the channel.

Figure 3:
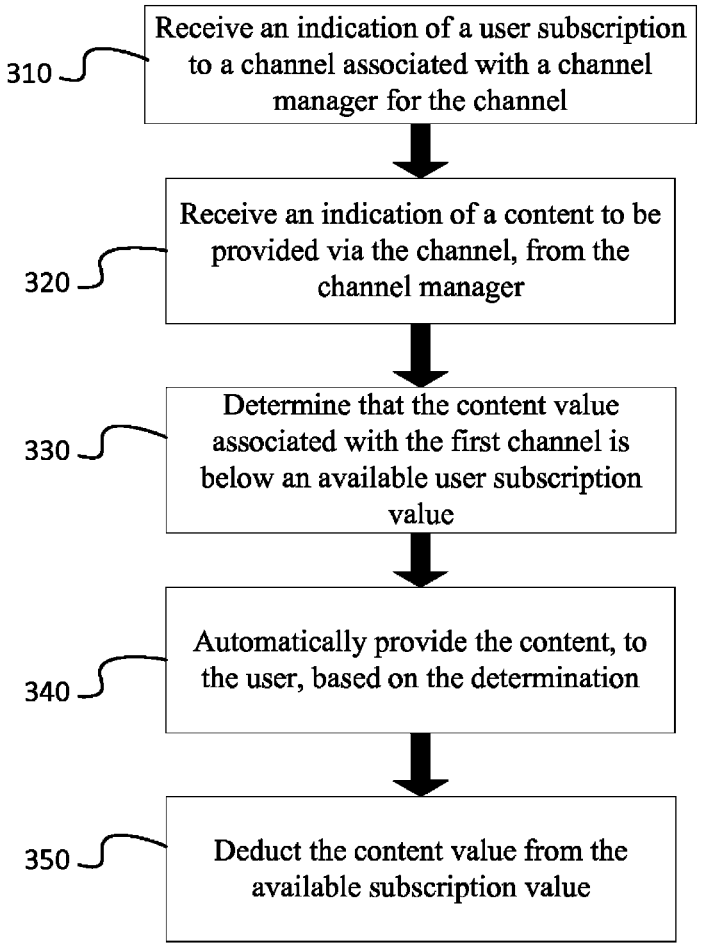
FIG. 3 shows an example process for providing content, according to an implementation of the disclosed subject matter.

According to implementations of the disclosed subject matter, as shown at step 310 in FIG. 3, an indication of a user subscription to a channel associated with a channel manger may be received. As disclosed herein, a user may subscribe to a channel to receive content that a channel manager associated with that channel selects. The indication of the user subscription may be any applicable confirmation that a user has subscribed to the channel. Some examples of indications may include a user signing up for the channel, receiving a payment from a user account, receiving a subscription token, receiving an encrypted message, or the like. As an example, a user may select a desired channel, via a channel interface, by directing an input device towards an icon for the channel and selecting the icon. Subsequently, the user may select a button that enables the user to subscribe to the channel. The selection of the button may be an indication of the user's subscription to the channel. As another example, a content manager may select content to be provided to subscribers of the channel. Upon receiving the content, the user accounts may be crawled to detect a token that indicates that a particular user is subscribed to the channel. Detection of the token may be an indication of the user's subscription to the channel.

According to implementations of the disclosed subject matter, as shown at step 320, an indication of a content to be provided via the channel, from the channel manager, may be received. As disclosed herein, a channel manager may select content (e.g., applications, software, media) to be provided to subscribers of a channel managed by the channel manger. The channel manager may be a trusted source such that users that subscribe to the channel manager's channel to receive content that they consider applicable to their preferences. For example, a user that prefers to play first person action games may subscribe to a channel for which the channel manager tests and suggests entertaining first person action games. The indication of a content to be provided via the channel may be any applicable confirmation that a channel manager has selected the content. Some examples of indications may include the channel manager selecting content from a pool of content items, submitting the content to be provided to subscribers, receiving an encrypted message, or the like. As an example, a channel manager may select content via a content selection webpage and may select a submit button to submit the content to subscribers. The selection may be an indication of the content to be provided via the channel.

According to implementations of the disclosed subject matter, as shown at step 330, a determination may be made whether the content value associated with the first channel is below an available user subscription value. As disclosed herein, an available subscription value may be the amount of funds available to a user for receiving applications. The available subscription value may be the value of funds remaining for a given channel such that the funds can be applied towards additional content via that channel. As a specific example, a user may subscribe to a channel for 10 dollars a month. At the beginning of the month, the available user subscription value may be 10 dollars. The channel manager may provide an application worth 2 dollars via the channel and the user may receive the application for download. Upon download of the application, 2 dollars may be deducted from the available funds such that the available user subscription value is reduced to 8 dollars. If the value of the content provided by the channel manager exceeds the available subscription value, then the user may not receive the content provided by via the channel. Continuing the pervious example, if, while the available subscription value is 8 dollars and the content manager provides an application that costs 9 dollars, then the user may not receive the application as the content value exceeds the available user subscription value. The user may receive a notification that the content value exceeds the available user subscription value and may be given the option to provide more funds to receive the application. According to an implementation, a channel manager may select which subscription level to provide content to. As an example, a channel manager may opt to provide a content that costs 1 dollar to a user that has subscription value of 10 dollars and may opt to send a 12 dollar item to a user that has a subscription value of 20 dollars.

According to implementations of the disclosed subject matter, as shown at step 340, content may be automatically provided to a user if the content value is below an available user subscription value. The content may be automatically provided such that the content is made available to a user for download or installation, downloaded or installed on a user device, downloaded on a user device, installed on a user device, or the like. As an example, a content manager may select a gaming application to be provided to subscribers via a channel. Subscribers with sufficient available user subscription values may receive a notification that the gaming application is available for installation on their respective user devices. The gaming application may be installed on the user devices upon respective user authorization (e.g., selection of a confirm button). As disclosed herein, in application purchases may be bundled with content such that a channel manager selects content along with in application items associated with the content to be provided to subscribers. Continuing the pervious example, the channel manager may select in application items along with the gaming application. The subscribers may receive the notification to install both the gaming application and the in application items or, alternatively, may be able to provide authorization for either the gaming application or the gaming application and the in application items.

According to implementations of the disclosed subject matter, as shown at step 350, the content value associated with content provided to users via a channel may be deducted from the available subscription value of a given user. The deduction may be made when a user is presented content, via the application, or may be deducted when a user provides authorization to accept (e.g., download, install, etc.) the application. According to an implementation, the deduction would not be made from a user's bank or charge account, but rather from the subscription account. Here, as disclosed herein, the subscription account may have an available user subscription value associated with the subscription account. The available user subscription value itself may increase based on a deposit from an external account (e.g., bank or charge account) at points determined by the subscription terms.

According to implementations of the disclosed subject matter, the content value for content provided via a channel may be discounted. The discount may be applied such that the value for the content, if received external to the channel, may be higher than the content value for the content provided via the channel. As an example, a block matching game may be 2 dollars if downloaded via an application market. However, an instance of the block matching game may be provided to a subscriber of a game channel for 1 dollar as a result of the subscriber receiving the block matching game via the channel. The amount of the discount may vary based on any applicable factor such as the channel, the subscriber, the amount allocated towards the channel per subscription period, or the like. As an example, a user that subscribes to a channel for 10 dollars a month may receive a fifteen percent discount on content provided via the channel. However, a different user that subscribes to the same channel for 20 dollars a month may receive a twenty percent discount on content provided via the channel.

According to implementations of the disclosed subject matter, a user may select a preference category along with a subscription to a channel. The preference category may define any applicable category such as a type of game (e.g., first person, numerical, point gathering, maturity rating, etc.), type of media (e.g., genre of music or videos, maturity rating, etc.), type of financial information, or the like. A category may be specific to a channel such that different channels may enable selection of different categories. As an example, a user may subscribe to a gaming applications channel and may select a numerical games category. A channel manager may select content to be provided via a channel and may also designate the category that the content is associated with. Continuing the pervious example, the content manager for the gaming applications channel may select a basketball game application and categorize it as a sporting application. The user may not be provided the basketball game application as the user selected numerical games as a preferred category. Here, the available user subscription value may not be reduced based on the channel manager providing the basketball game application. Essentially, selecting one or more categories may enable a user to further define the content provided to the user.

According to an implementation of the disclosed subject matter, a channel manager may be compensated based on the number of users that subscribe to the channel associated with the channel manager. The compensation may incentivize a channel manager to provide content, via the channel, that is relevant to a large number of users. As an example, a channel manager for a channel with 100 subscribers may receive 10 cents per subscriber per subscription period such that the channel manager receives 10 dollars per subscription period. Alternatively, a channel manager for a channel with 1000 subscribers may receive 10 cents per subscriber per subscription period such that the channel manager receives 100 dollars per subscription period. Alternatively, a channel manager may be compensated based on the amount of content that is authorized by subscribers to be installed or downloaded on their respective user devices. As disclosed herein, content provided via a channel may be required to be authorized prior to being installed and prior to a deduction being made from an available subscription value. Accordingly, as an example, a channel manager may receive a percentage of each content item that is installed or downloaded (e.g., for which a deduction is made from an available subscription value).

Figure 4:
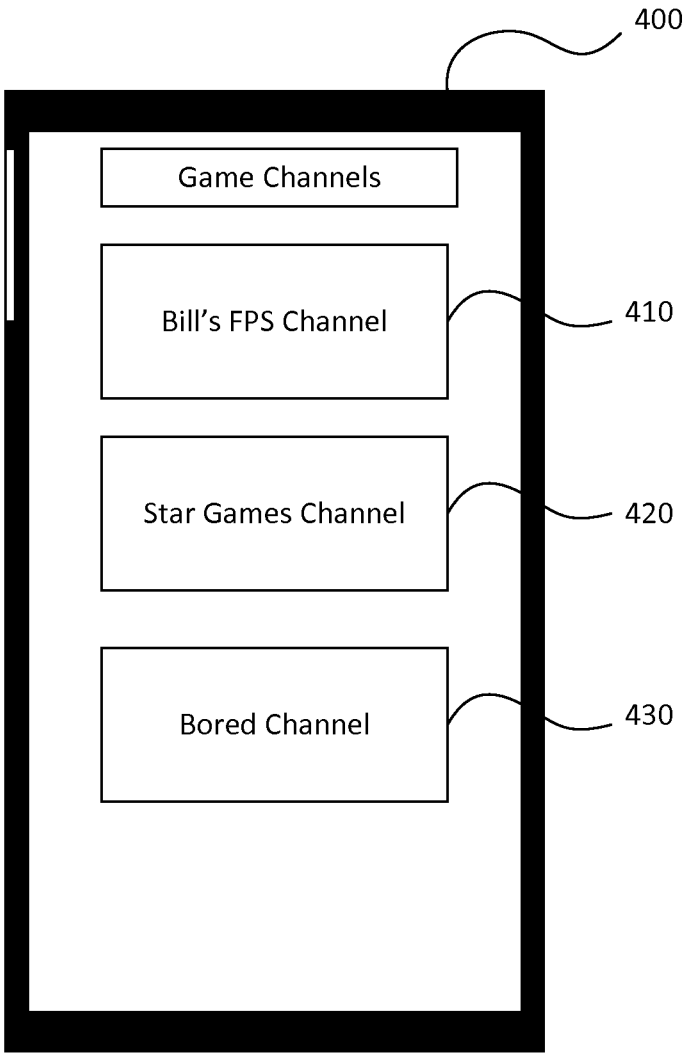
FIG. 4 shows an example illustration of a mobile phone with channel options, according to an implementation of the disclosed subject matter.
Figure 5:
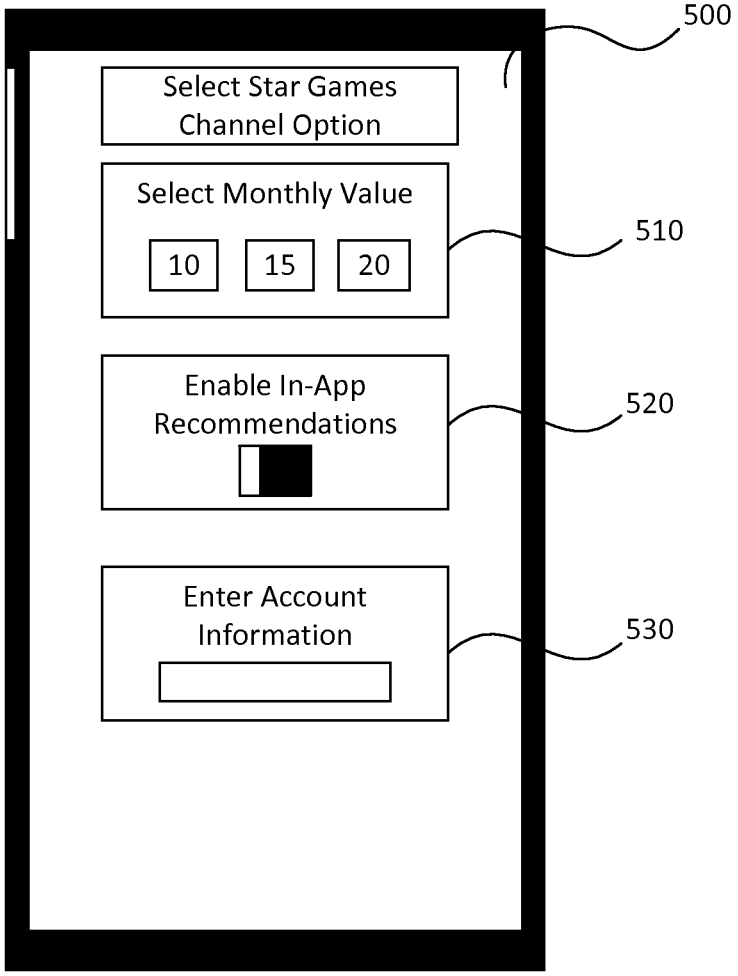
FIG. 5 shows an example illustration of a mobile phone with channel settings, according to an implementation of the disclosed subject matter.

FIGS. 4 and 5 show an illustrative example of the disclosed subject matter. According to this example, a user may use a user device 400 to access an available game channels page. The available game channels page may contain three channels: Bill's FPS Channel 410, Star Games Channels 420, and the Bored Channel 430. The user may select the Star Games Channel 420 and be presented the Star Games Option Page 500. The star games option page may contain a monthly value selection option 510 that enables the user to select either 10, 15, or 20 dollars a month for the subscription. Additionally, the Star Games option page may contain an Enable In-App Recommendations option 520 such that a user can select whether or not to receive in application items along with content. Additionally, the Star Games Options page may contain an area 530 for the user to input account information. The account information may correspond to an umbrella account that is associated with the user's financial account or may correspond to a financial account directly.

Implementations of the presently disclosed subject matter may be implemented in and used with a variety of component and network architectures (e.g., online network that enables multiplayer gameplay). FIG. 1 is an example computer 20 (e.g., a game console, desktop gaming machine, etc.) suitable for implementing implementations of the presently disclosed subject matter. Alternatively, any device disclosed herein configured to electronically transport, generate, or modify data or information may utilize a computer. The computer (e.g., microcomputer) 20 includes a bus 21 which interconnects major components of the computer 20, such as a central processor 24, a memory 27 (typically RAM, but which may also include ROM, flash RAM, or the like), an input/output controller 28, a player display 22, such as a display or touch screen via a display adapter, a player input interface 26, which may include one or more controllers and associated player input or devices such as a keyboard, mouse, WiFi/cellular radios, touchscreen, microphone/speakers and the like, and may be closely coupled to the I/O controller 28, fixed storage 23, such as a hard drive, flash storage, Fibre Channel network, SAN device, SCSI device, and the like, and a removable media component 25 operative to control and receive an optical disk, flash drive, and the like.

The bus 21 allows data communication between the central processor 24 and the memory 27, which may include read-only memory (ROM) or flash memory (neither shown), and random access memory (RAM) (not shown), as previously noted. The RAM can include the main memory into which the operating system and application programs are loaded. The ROM or flash memory can contain, among other code, the Basic Input-Output system (BIOS) which controls basic hardware operation such as the interaction with peripheral components. Applications resident with the computer 20 can be stored on and accessed via a computer readable medium, such as a hard disk drive (e.g., fixed storage 23), an optical drive, floppy disk, or other storage medium 25.

The fixed storage 23 may be integral with the computer 20 or may be separate and accessed through other interfaces. A network interface 29 may provide a direct connection to a remote server via a telephone link, to the Internet via an internet service provider (ISP), or a direct connection to a remote server via a direct network link to the Internet via a POP (point of presence) or other technique. The network interface 29 may provide such connection using wireless techniques, including digital cellular telephone connection, Cellular Digital Packet Data (CDPD) connection, digital satellite data connection or the like. For example, the network interface 29 may allow the computer to communicate with other computers via one or more local, wide-area, or other networks, as shown in FIG. 2.

Many other devices or components (not shown) may be connected in a similar manner (e.g., document scanners, digital cameras and so on). Conversely, all of the components shown in FIG. 1 need not be present to practice the present disclosure. The components can be interconnected in different ways from that shown. The operation of a computer such as that shown in FIG. 1 is readily known in the art and is not discussed in detail in this application. Code to implement the present disclosure can be stored in computer-readable storage media such as one or more of the memory 27, fixed storage 23, removable media 25, or on a remote storage location.

Figure 2:
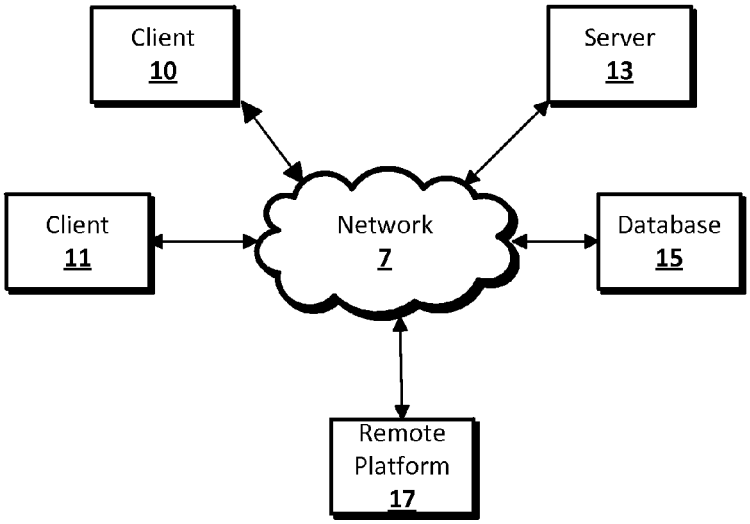
FIG. 2 shows a network configuration according to an implementation of the disclosed subject matter.

FIG. 2 shows an example network arrangement according to an implementation of the disclosed subject matter. One or more clients 10, 11, such as smart power devices, microcomputers, local computers, smart phones, tablet computing devices, and the like may connect to other devices via one or more networks 7 (e.g., a power distribution network). The network may be a local network, wide-area network, the Internet, or any other suitable communication network or networks, and may be implemented on any suitable platform including wired and/or wireless networks. The clients may communicate with one or more servers 13 and/or databases 15. The devices may be directly accessible by the clients 10, 11, or one or more other devices may provide intermediary access such as where a server 13 provides access to resources stored in a database 15. The clients 10, 11 also may access remote platforms 17 or services provided by remote platforms 17 such as cloud computing arrangements and services. The remote platform 17 may include one or more servers 13 and/or databases 15.

More generally, various implementations of the presently disclosed subject matter may include or be implemented in the form of computer-implemented processes and apparatuses for practicing those processes. Implementations also may be implemented in the form of a computer program product having computer program code containing instructions implemented in non-transitory and/or tangible media, such as floppy diskettes, CD-ROMs, hard drives, USB (universal serial bus) drives, or any other machine readable storage medium, wherein, when the computer program code is loaded into and executed by a computer, the computer becomes an apparatus for practicing implementations of the disclosed subject matter. Implementations also may be implemented in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing implementations of the disclosed subject matter. When implemented on a general-purpose microprocessor, the computer program code segments configure the microprocessor to create specific logic circuits. In some configurations, a set of computer-readable instructions stored on a computer-readable storage medium may be implemented by a general-purpose processor, which may transform the general-purpose processor or a device containing the general-purpose processor into a special-purpose device configured to implement or carry out the instructions. Implementations may be implemented using hardware that may include a processor, such as a general purpose microprocessor and/or an Application Specific Integrated Circuit (ASIC) that implements all or part of the techniques according to implementations of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to implementations of the disclosed subject matter.

The foregoing description, for purpose of explanation, has been described with reference to specific implementations. However, the illustrative discussions above are not intended to be exhaustive or to limit implementations of the disclosed subject matter to the precise forms disclosed. Many modifications and variations are possible in view of the above teachings. The implementations were chosen and described in order to explain the principles of implementations of the disclosed subject matter and their practical applications, to thereby enable others skilled in the art to utilize those implementations as well as various implementations with various modifications as may be suited to the particular use contemplated.

The invention claimed is:

1. A method comprising:

receiving an indication of a user subscription, at a computing device, to a channel associated with a channel manager for the channel, wherein the channel provides content that is selected by the channel manager to the computing device via a server;

receiving an indication of a first content, at the computing device, to be provided via the channel, from the server associated with the channel manager for the channel;

receiving a selection, at the computing device, to be provided at least one recommended application based on the first content;

determining that a content value associated with the first content is below an available user subscription value;

automatically receiving, at the computing device via a computer network, the first content and the at least one recommended application, based on the determination and based on detection of a token associated with the user subscription by the server associated with the channel manager; and deducting the content value from the available subscription value.

2. The method of claim 1, wherein the indication of the user subscription to the channel is received based on the user selecting the channel via the computing device.

3. The method of claim 1, wherein the subscription to the channel comprises a category.

4. The method of claim 1, wherein receiving an indication of a first content comprises receiving a selection, by the channel manager, to provide the indication at the computing device via the computer network.

5. The method of claim 1, wherein the indication of the first content comprises a category.

6. The method of claim 1, wherein the content value corresponds to a discounted value for the first content.

7. The method of claim 1, wherein the available user subscription value increases automatically at a replenish period.

8. The method of claim 7, wherein the replenish period is a time period.

9. The method of claim 8, wherein the time period is one selected from the group consisting of: a day, a week, a month, and a year.

10. The method of claim 7, wherein the available user subscription value is replenished by receiving funds from a user account.

11. The method of claim 1, wherein the channel manager receives input from at least one selected from the group consisting of: an individual, a company, and a group of users.

12. The method of claim 1, wherein the channel manager receives compensation based on the number of users that subscribe to the channel.

13. The method of claim 1, further comprising:

receiving, at the computing device, an indication of a second content to be provided via the channel, from the server associated with the channel manager for the channel;

determining that a content value associated with the second content is below an available user subscription value;

automatically receiving the second content at the computing device, based on the determination; and deducting the content value from the available subscription value.

14. The method of claim 1, wherein the first content is not publically available without the subscription to the channel.

15. A system comprising:

a computing device configured to:

receive an indication of a user subscription, by a user, to a channel associated with a channel manager for the channel, wherein the channel provide content that is selected by the channel manager to the computing device via a server;

receive an indication of a first content to be provided via the channel, from the server associated with the channel manager for the channel;

receive a selection to be provided at least one recommended application based on the first content; and determine that a content value associated with the first content is below an available user subscription value;

automatically provide the first content and the at least one recommended application to the computing device via a computer network, based on the determination and based on detection of a token associated with the user subscription by the server associated with the channel manager; and deduct the content value from the available subscription value.

16. The system of claim 15, wherein the indication of the user subscription to the channel is received based on the user selecting the channel via the computing device.

17. The system of claim 15, wherein the subscription to the channel comprises a category.

18. The system of claim 15, wherein receiving an indication of a first content comprises receiving a selection, by the channel manager, to provide the indication via the computing device.

19. The system of claim 15, wherein the indication of the first content comprises a category.

20. The system of claim 15, wherein the content value corresponds to a discounted value for the first content.

21. The system of claim 15, wherein the available user subscription value increases automatically at a replenish period.

22. The system of claim 21, wherein the replenish period is a time period.

23. The system of claim 22, wherein the time period is one selected from the group consisting of: a day, a week, a month, and a year.

24. The method of claim 21, wherein the available user subscription value is replenished by receiving funds from a user account.

25. The system of claim 15, wherein the server associated with the channel manager receives input from at least one selected from the group consisting of: an individual, a company, and a group of users.

26. The system of claim 15, wherein the channel manager receives compensation based on the number of users that subscribe to the channel.

27. The system of claim 15, wherein:

the computing device is further configured to:

receive an indication of a second content to be provided via the channel, from the server associated with the channel manager for the channel; and determine that a content value associated with the second content is below an available user subscription value;

automatically provide the second content to the computing device, based on the determination; and deduct the content value from the available subscription value.

28. The system of claim 15, wherein the first content is not publically available without the subscription to the channel.

29. The method of claim 1, wherein the channel manager receives compensation based on the amount of content authorized by the user.

30. The system of claim 15, wherein the channel manager receives compensation based on the amount of content authorized by the user.

* * * * *